US010677506B2

(12) United States Patent
Guo et al.

(10) Patent No.: US 10,677,506 B2
(45) **Date of Patent: *Jun. 9, 2020**

(54) ICE STORAGE DEVICE AND REFRIGERATOR

(71) Applicant: Hisense Ronshen (Guangdong) Refrigerator Co., Ltd., Foshan, Guangdong (CN)

(72) Inventors: Gang Guo, Guangdong (CN); Meiyan Wang, Guangdong (CN); Xiaofen Long, Guangdong (CN); Wen Zeng, Guangdong (CN); Qiang Liao, Guangdong (CN); Feiyue You, Guangdong (CN)

(73) Assignee: Hisense Ronshen (Guangdong) Refrigerator Co., Ltd., Foshan, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/159,362

(22) Filed: Oct. 12, 2018

(65) Prior Publication Data

US 2019/0049166 A1 Feb. 14, 2019

Related U.S. Application Data

(63) Continuation of application No. 15/032,451, filed as application No. PCT/CN2015/075515 on Mar. 31, 2015, now Pat. No. 10,132,545.

(30) Foreign Application Priority Data

Feb. 3, 2015 (CN) ..... 2015 1 0056903

(51) Int. Cl.
*F25C 5/04* (2006.01)
*F25C 5/20* (2018.01)

(52) U.S. Cl.
CPC ..... *F25C 5/046* (2013.01); *F25C 5/24* (2018.01); *F25C 5/22* (2018.01); *F25C 2500/02* (2013.01)

(58) Field of Classification Search
CPC ..... F25C 5/24; F25C 5/22; F25C 2500/02; F25C 5/046
See application file for complete search history.

(56) References Cited

U.S. PATENT DOCUMENTS 7,111,473 B2 9/2006 Chung et al.
2004/0261442 A1 12/2004 Chung et al.
(Continued)

FOREIGN PATENT DOCUMENTS

CA 2 719 680 5/2011
CN 200946955 9/2007
(Continued)

OTHER PUBLICATIONS

Office Action in corresponding Chinese Application No. 201510056903.6 dated Jan. 2, 2018.
(Continued)

*Primary Examiner* — Ana M Vazquez
(74) *Attorney, Agent, or Firm* — Brinks Gilson & Lione

(57) ABSTRACT

An ice storage device includes an ice storage box, an ice discharging door, an ice crushing device and at least one stirrer. The ice crushing device includes at least one fixed ice crushing blade and at least one moving ice crushing blade which is provided on a rotating shaft and rotates synchronously to the rotating shaft. The at least one stirrer is provided on the rotating shaft and rotates synchronously to the rotating shaft, and the stirrer includes a stirring body having at least one stirring finger on its outer surface.

20 Claims, 5 Drawing Sheets

(56) References Cited

U.S. PATENT DOCUMENTS

| | | | | |
|---|---|---|---|---|
| 2006/0213213 | A1 | 9/2006 | Chung et al. | |
| 2008/0295538 | A1* | 12/2008 | Kim | F25C 5/24 62/354 |
| 2009/0293529 | A1 | 12/2009 | Shinohara et al. | |
| 2010/0024461 | A1 | 2/2010 | Buchstab et al. | |
| 2010/0224726 | A1 | 9/2010 | Lu et al. | |
| 2011/0146325 | A1 | 6/2011 | Lee | |

FOREIGN PATENT DOCUMENTS

| | | | |
|---|---|---|---|
| CN | 101573572 | | 11/2009 |
| CN | 102278843 | A | 12/2011 |
| CN | 102818411 | A | 12/2012 |
| CN | 104006595 | | 8/2014 |
| CN | 104390402 | | 3/2015 |
| CN | 204227784 | | 3/2015 |
| EP | 2 808 627 | A2 | 3/2014 |
| KR | 10-2008-0036696 | A | 4/2008 |
| WO | WO 2008/051013 | A2 | 5/2008 |

OTHER PUBLICATIONS

Extended European Search Report in corresponding European Application No. 15880803.0 dated Nov. 8, 2017.

International Search Report and Written Opinion for corresponding International Application No. PCT/CN2015/075515 dated Oct. 29, 2015.

* cited by examiner

ICE STORAGE DEVICE AND REFRIGERATOR

CROSS-REFERENCE TO RELATED APPLICATIONS

This application is a continuation of U.S. patent application Ser. No. 15/032,451, filed Apr. 27, 2016, which claims priority to PCT/CN2015/075515 filed Mar. 31, 2015, which claims priority to Chinese Patent Application No. 201510056903.6, submitted to China Patent Office on Feb. 3, 2015, each entitled "ICE STORAGE DEVICE AND REFRIGERATOR." All applications listed in this paragraph are herein incorporated by reference in their entireties.

FIELD OF INVENTION

The present disclosure relates to the technical field of household appliances, and in particular to an ice storage device and a refrigerator.

BACKGROUND

With the continuous improvement of people's living standards, multifunctional high-grade refrigerators have become popular with more and more consumers. For example, some high-grade refrigerators are equipped with an automatic ice maker. That is, they have a function of automatically ice making.

Generally, an automatic ice maker includes an ice making device, an ice storage device, etc. The ice making device stores the obtained ice cubes into the ice storage device, and then consumers take some ice cubes from the ice storage device as needed.

BRIEF SUMMARY

In one embodiment of the present disclosure, an ice storage device is provided. Said ice storage device includes an ice storage box, an ice discharging door is provided at an outlet of said ice storage box, an ice crushing device is provided inside said ice storage box, said ice crushing device includes at least one fixed ice crushing blade and at least one moving ice crushing blade which is sleeved on a rotating shaft and rotates synchronously to said rotating shaft, and said rotating shaft is connected to a driving device.

At least one stirrer is sleeved on said rotating shaft and rotates synchronously to the rotating shaft, said stirrer includes a columnar stirring body having at least one stirring finger on its columnar outer surface, and said stirring finger is arranged obliquely or perpendicular to an axial direction of said rotating shaft.

In one embodiment of the present disclosure, at least two said stirring fingers are uniformly arranged along the circumference of said stirring body.

In one embodiment of the present disclosure, said stirring finger includes a first stirring portion and a second stirring portion, one end of said first stirring portion is fixedly connected to the columnar outer surface of said stirring body and the other end thereof is connected to said second stirring portion, and said second stirring portion is arranged obliquely or perpendicular to said first stirring portion.

In one embodiment of the present disclosure, there is one said ice discharging door.

In one embodiment of the present disclosure, an elastic element is provided between said ice discharging door and said ice storage box.

In one embodiment of the present disclosure, said ice discharging door is articulated with said ice storage box.

In one embodiment of the present disclosure, at least one reinforced rib is provided on a surface of said ice discharging door facing the interior of said ice storage box.

In one embodiment of the present disclosure, said fixed ice crushing blade is located at the position of the outlet of said ice storage box, with one end of the fixed ice crushing blade being fixedly connected to the ice storage box and the other end thereof being hollowly sleeved on said rotating shaft; and said fixed ice crushing blade has a first ice crushing face and a first backside which are arranged away from and oppositely to each other, with said first ice crushing face being away from the outlet of said ice storage box and having first ice crushing teeth, and said first backside facing the outlet of said ice crushing box.

In one embodiment of the present disclosure, said moving ice crushing blade has a second ice crushing face and a second backside which are axially parallel to said rotating shaft and are arranged away from each other; and said moving ice crushing blade moves toward said fixed ice crushing blade, and during the ice crushing, said second ice crushing face faces said first ice crushing face, and said second ice crushing face has second ice crushing teeth; and said second backside is planar.

In another embodiment of the present disclosure, a refrigerator is provided. Said refrigerator includes an ice maker having the ice storage device as described above. An inlet of said ice storage device is communicated to an outlet of said ice maker.

BRIEF DESCRIPTION OF THE DRAWINGS

In order to describe technical solutions in embodiments of the present disclosure or in the prior art more clearly, the accompanying drawings to be used in the description of embodiments or the prior art will be introduced briefly. Obviously, the accompanying drawings to be described below are merely some embodiments of the present disclosure, and a person of ordinary skill in the art can obtain other drawings according to those drawings without paying any creative effort.

FIG. 5 is a stereoscopic structure diagram of a refrigerator according to an embodiment of the present disclosure, in which:

1: ice storage box;
2: stirrer;
3: ice discharging door;
4: fixed ice crushing blade;
5: moving ice crushing blade;
6: rotating shaft;
201: stirring body;
202: first stirring portion;
203: second stirring portion;
204: stirring axle hole;
301: reinforced rib;
302: articulated hole;

401: first ice crushing teeth;
402: first backside;
501: second ice crushing teeth; and
502: second backside.

DETAILED DESCRIPTION

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

With the continuous improvement of people's living standards, refrigerators have become a necessity of life. Refrigerators can, by maintaining its interior in a low temperature state by means of refrigerating, not only store food, but also provide ice cubes by arrangement of an ice maker. Generally, an ice maker includes an ice making device, an ice storage device, etc. The ice making device is configured to make ice cubes and store the obtained ice cubes into the ice storage device, and then consumers take some ice cubes from the ice storage device as needed.

Generally, an ice storage device primarily consists of an ice storage box and an ice crushing device. The ice crushing device is located within the ice storage box, and mainly includes at least one fixed ice crushing blade, at least one moving ice crushing blade and a rotating shaft. Each moving ice crushing blade rotates synchronously to the rotating shaft. When rotating toward the direction of the fixed ice crushing blade, the moving ice crushing blade may crush ice cubes and discharge them from the ice storage box. Otherwise, when rotating away from the direction of the fixed ice crushing blade, the moving ice crushing blade may stir and squeeze ice cubes so that ice cubes force the ice discharging door to open and then discharge from the ice storage box. During the discharge of large ice cubes or entire ice cubes, ice cubes are stirred by the moving ice crushing blade. Since the surfaces of ice cubes are smooth and it is thus not easy to stir ice cubes, the pushing force stressed by ice cubes onto the ice discharging door is small. Consequently, problems such as difficult opening of the ice discharging door and low discharge rate of ice cubes often occur.

Figure 1:
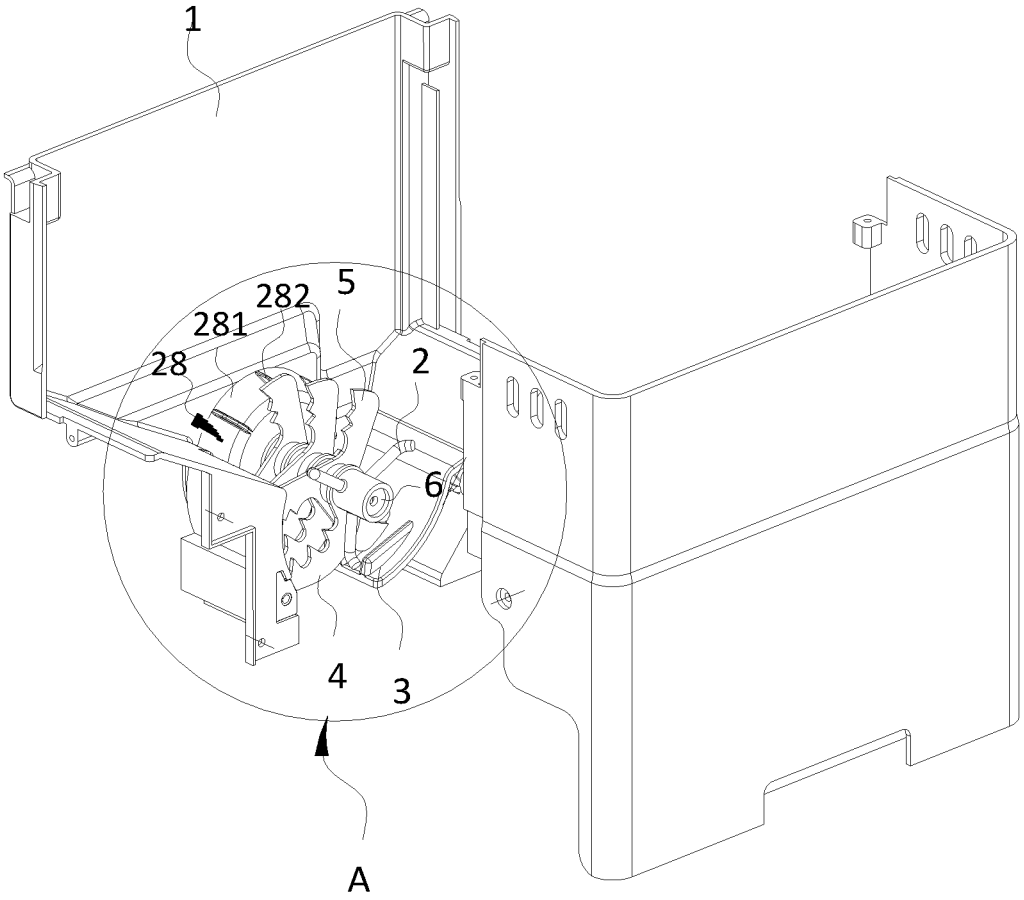
FIG. 1 is a stereoscopic structure diagram of an ice storage device according to an embodiment of the present disclosure.
Figure 2:
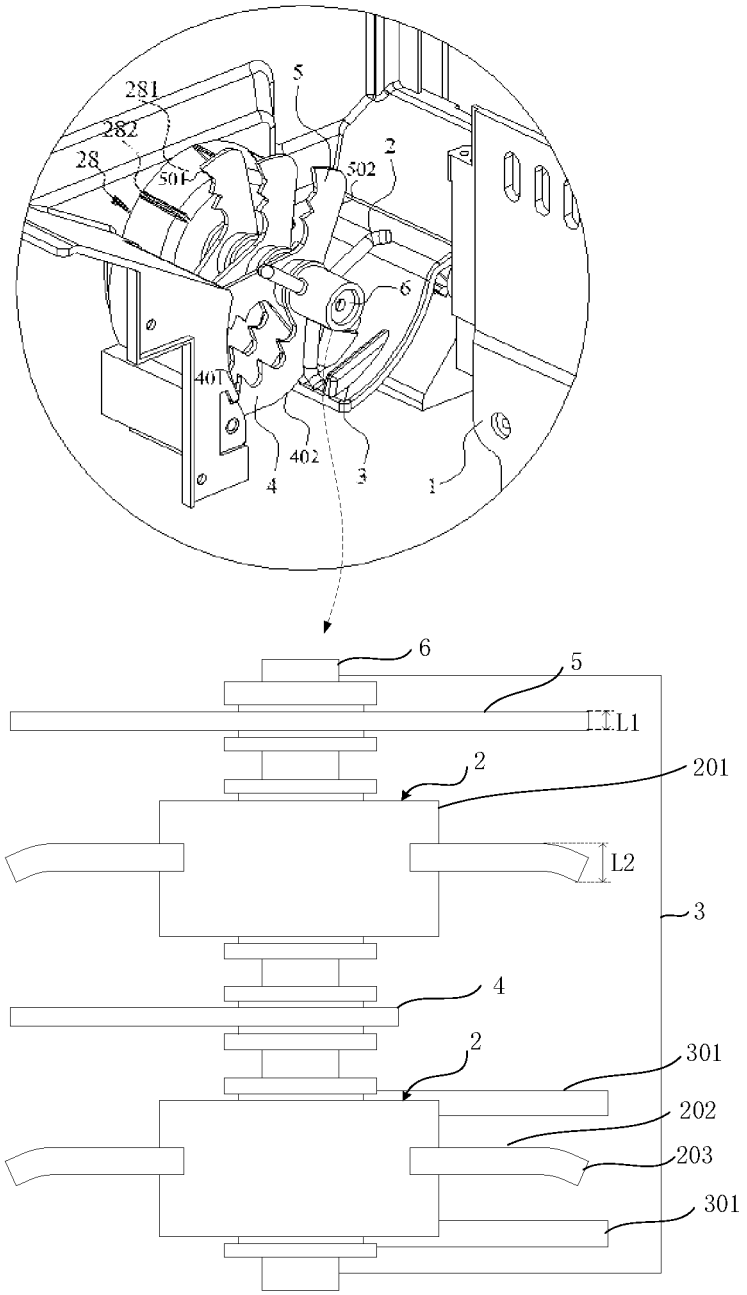
FIG. 2 is a schematic diagram of a partially enlarged structure of part A of FIG. 1.

One embodiment of the present disclosure provides an ice storage device, as shown in FIG. 1 and FIG. 2, including an ice storage box 1. An ice discharging door 3 is provided at an outlet of the ice storage box 1. An ice crushing device is provided inside the ice storage box 1, and the ice crushing device comprises at least one fixed ice crushing blade 4 and at least one moving ice crushing blade 5. Each moving ice crushing blade 5 is sleeved on a rotating shaft 6 and both rotate synchronously. The rotating shaft 6 is connected to a driving device (for example, a motor) which is configured to drive the rotating shaft 6 to rotate.

Figure 3:
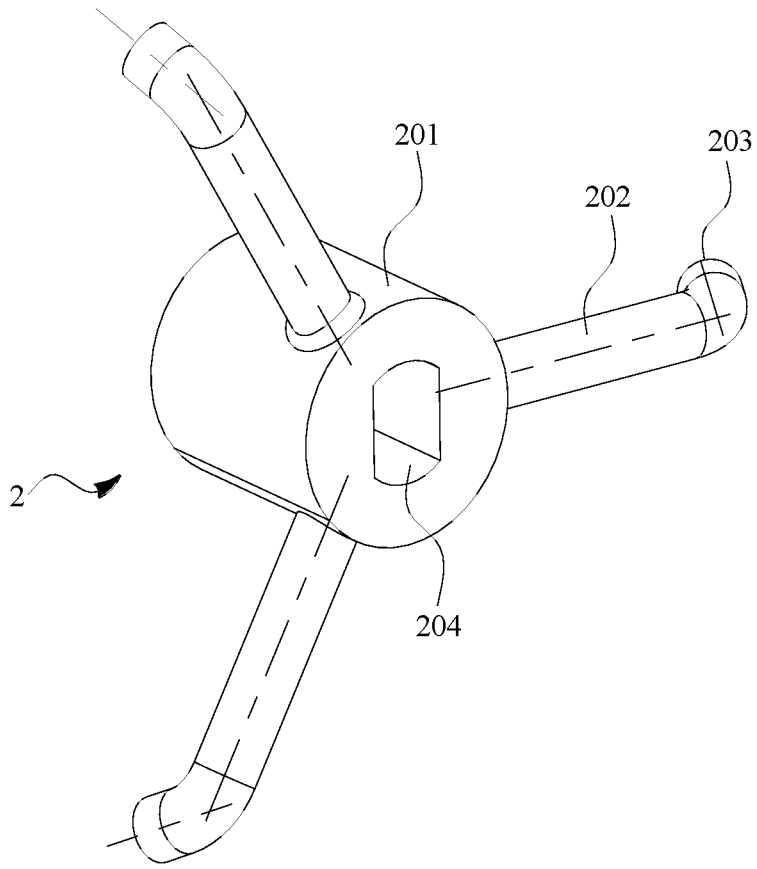
FIG. 3 is a stereoscopic structure diagram of a stirrer according to an embodiment of the present disclosure.

Still referring to FIG. 1 and FIG. 2, a stirrer 2 is further sleeved on the rotating shaft 6, and the stirrer 2 rotates synchronously to the rotating shaft 6. As shown in FIG. 3, the stirrer 2 includes a columnar stirring body 201 having at least one stirring finger on its columnar outer surface, the stirring finger is arranged obliquely or perpendicular to an axial direction of the rotating shaft 6, and a gap is maintained between the tip of the stirring finger and the ice discharging door 3.

Still referring to FIG. 1 and FIG. 2, a stirring plate 28 is further provided on the rotating shaft 6. The stirring plate 28 includes a base 281, an outer peripheral surface of the base 281 is conical, and a radius of the base 281 (i.e. the distance from the outer peripheral surface of the base 281 to the rotating shaft 6) gradually decreases in a direction approaching to the ice crushing device. At least one rib protrusion 282 is disposed on the outer peripheral surface of the base 281. The rotating shaft 6 drives the stirring plate 28 to rotate when the ice is crushed. And then ice cubes are stirred and pushed when the stirring plate 28 rotates, so as to break up the ice cubes stuck together with each other, thereby solving the problem that the stuck ice cubes cannot rotate with the crushing blade 5 after a long time of storage.

The center of the base 281 of the stirring plate 28 is provided with a through hole that can be engaged with the rotating shaft 6. The through hole has a non-circular cross section, and the rotating shaft 6 passes through the through hole at the center of the base 281. Alternatively, the rotating shaft 6 and the stirring plate 28 are attached by a key connection.

As shown in FIG. 1 and FIG. 2, there are a plurality of rib protrusions 282 distributed uniformly on the outer peripheral surface of the base 281, so as to get better effect for stirring and pushing the ice cubes.

It is to be noted that, the expression "the stirring finger is arranged obliquely or perpendicular to an axial direction of the stirring body 201" means that, the stirring finger is not parallel to the axial direction of the stirring body 201, and instead, it is arranged at a certain oblique angle to the axial direction of the stirring body. When this oblique angle is approximate to (or equal to) 90°, the stirring finger may be allowed to have a large radial dimension at its tip even with a small (minimal) length. This radial dimension is a radial distance from the axis of the rotating shaft. As a result, the end of the stirring finger gets close to the ice discharging door 3. With such an arrangement, the stirring finger may be allowed to stir more ice cubes, and thus, more ice cubes push the ice discharging door 3 and the pushing force stressed onto the ice discharging door 3 is correspondingly increased. Hence, it is easier to open the ice discharging door 3, and then the discharge rate of ice cubes is improved.

In addition, in this embodiment, since the stirring body 201 and the rotating shaft 6 are required to rotate synchronously, they are fixedly connected to each other. The connection may be realized by interference fit, or the position where the rotating shaft 6 and the stirring body 201 are connected to each other is designed in a special shape. For example, the rotating shaft 6 at this position is designed as a flat shaft, and correspondingly the stirring body 201 is designed as a through hole having a flat surface, like a stirring axle hole 204 as shown in FIG. 3. The connection also may be realized by keys, for example, flat keys, splines or the like.

In this embodiment, the gap is maintained between the tip of said stirring finger and the ice discharging door 3 so that the stirring finger may freely rotate around the rotating shaft 6. This gap cannot be too large, or otherwise ice cubes are likely to escape from the ice storage box 1.

In this embodiment, the stirrer 2 designed to facilitate the opening of the ice discharging door 3 is provided inside the ice storage box 1, the rotating shaft 6 is driven to rotate by a driving device (for example, a motor), the rotating shaft 6 in turn drives the stirring body 201 to rotate, the stirring body 201 further drives the at least one stirring finger to rotate, and the at least one stirring finger stirs and pushes some ice cubes toward the ice discharging door 3 so that the ice discharging door 3 is forced to open by the pushing of ice cubes. In comparison with the prior art, in an ice storage device with such a structure, by pushing ice cubes by the at least one stirring finger, the ice discharging door 3 is forced to open by the pushing of ice cubes. In comparison with a moving ice crushing blade, there is a large contact area between the stirring finger and ice cubes, that is, there is a large acting area for pushing ice cubes, so that it is very easy to stir more ice cubes and force the ice discharging door 3 to open by the pushing of some ice cubes. That is, the pushing force stressed by ice cubes onto the ice discharging door 3 can be increased, so that the ice discharging door 3 may be opened much more easily and the discharge rate of ice cubes may be improved.

To increase the pushing force stressed by the stirrer 2 onto the ice discharging door 3, at least two said stirring fingers may be uniformly arranged in the circumference of the stirring body 201. As shown in FIG. 1 to FIG. 3, the stirrer 2 has three said stirring fingers which, having a three-jaw chuck structure, are circumferentially and uniformly distributed on the outer surface of the stirring body 201. Of course, there may be 4, 5, 6 or more said stirring fingers.

As shown in FIG. 3, each stirring finger includes a first stirring portion 202 and a second stirring portion 203. One end of the first stirring portion 202 is fixedly connected to the columnar outer surface of the stirring body 201, and the other end thereof is connected to the second stirring portion 203. The second stirring portion 203 is arranged obliquely or perpendicular to the first stirring portion 202.

It is to be noted that the arrangement of the second stirring portion 202 may increase the surface area of the tip of the first stirring portion 202, so that the first stirring portion 202 can contact more ice cubes at its tip to thereby stir more ice cubes and increase the pushing force stressed onto the ice discharging door 3. That is, the tip of the first stirring portion 202 may stir more ice cubs so that more ice cubes push the ice discharging door 3, and as a result, it is easier to open the ice discharging door 3. When the ice discharging door 3 is opened, more ice cubes may be taken out, and thus the discharge rate of ice cubes is further improved.

In this embodiment, there are many ways of connecting the first stirring portion 202 and the second stirring portion 203. For example, the first stirring portion 202 and the second stirring portion 203 form an integrated structure. This integrated structure may be produced by powder metallurgy, bending, casting or welding or the like. As another example, the first stirring portion 202 and the second stirring portion 203 may be fixedly connected in a detachable manner. This fixed connection in a detachable manner may be realized by threading, riveting or the like.

The expression "the second stirring portion 203 is arranged obliquely or perpendicularly to the first stirring portion 202" means that the second stirring portion 203 is arranged at a certain angle with respect to, not in parallel to, the first stirring portion 202. The shape, formed after the first stirring portion 202 and the second stirring portion 203 are connected to each other, may be similar to an "L" shape or a "T" shape, and will not be specifically defined herein. When the shape, formed after the first stirring portion 202 and the second stirring portion 203 are connected to each other, is similar to the "L" shape, their connection is smooth arc transition, and an included angle between the two stirring portions is not less than 90°. When the two stirring portions form the integrated structure by bending, a larger included angle between the two stirring portions indicates a higher strength at the bending position. However, the included angle should not be too large. Of course, the included angle between the two stirring portions may be set to be less than 90°.

In addition, when the stirrer 2 is mounted at both ends of the rotating shaft 6 or close to the inner surface of the ice storage box 1, it is better to make an end of the second stirring portion 203 which is far away from the stirring body 201 closer to the inner surface of the ice storage box 1 than the other end of the second stirring portion 203 which is close to the stirring body 201. This prevents ice cubs at that position from sticking due to long period of immobility.

In this embodiment, as shown in FIG. 1 and FIG. 2, only one stirrer 2 is mounted inside the ice storage box 1. Additionally, more stirrers 2 may be mounted. In a rational range, more stirrers 2 provide a larger stirring force and a larger pushing force stressed onto the ice discharging door 3. Hence, it is easier to open the ice discharging door 3, and the discharge rate of ice cubes will be higher. When two stirrers 2 are mounted, the two stirrers 2 may be placed at both ends of the rotating shaft 6 inside the ice storage box 1, and all ice crushing blades are mounted between the two stirrers 2. When three or more stirrers 2 are mounted, the stirrers 2 and the ice crushing blades may be alternately arranged.

In this embodiment, in order to simplify the structure of the ice storage device, as shown in FIG. 1 and FIG. 2, only one ice discharging door 3 is provided. Since there is only one ice discharging door 3, the structure of this ice storage device is simplified.

Additionally, in order to ensure that the ice discharging door 3 may return to its original position quickly after discharging ice cubes to block the outlet of the ice storage box 1 quickly, an elastic element may be provided between the ice discharging door 3 and the ice storage box 1, for example, a spiral spring, a butterfly spring, a torsional spring or the like. When it is to take ice cubes, ice cubes push the ice discharging door 3 to compress the elastic element and force the ice discharging door 3 to open. At the end of taking ice cubes, since no pressure is stressed by ice cubes onto the ice discharging door 3, the ice discharging door 3 returns to its original position due to the elastic element and then closes.

Figure 4:
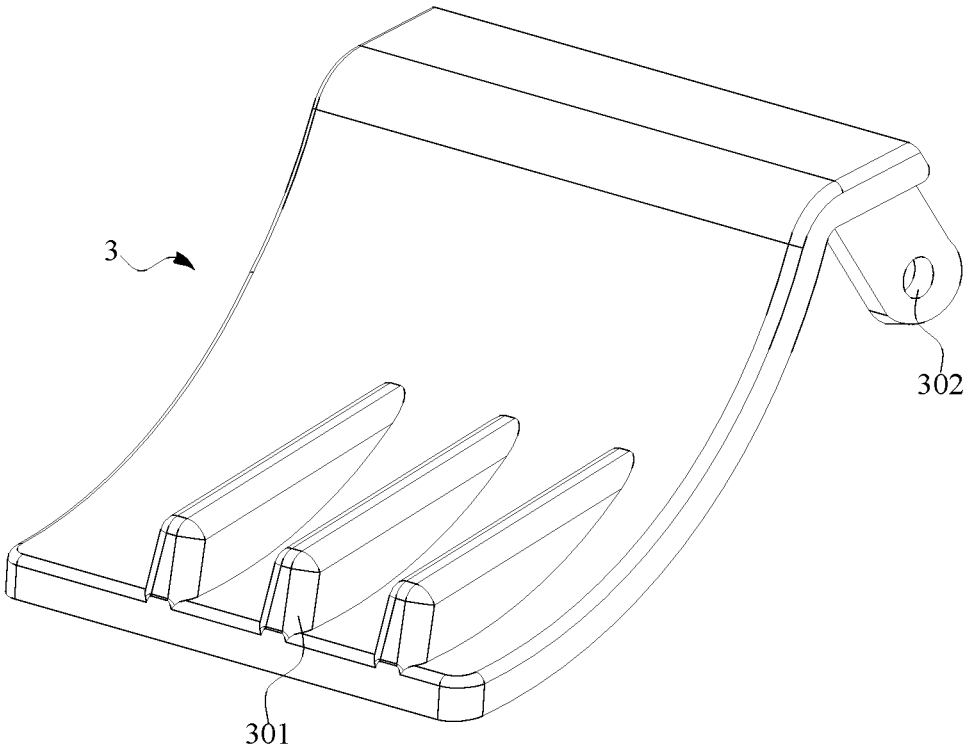
FIG. 4 is a stereoscopic structure diagram of an ice discharging door according to an embodiment of the present disclosure.

To open the ice discharging door 3 conveniently, as shown in FIG. 4, the ice discharging door 3 is usually designed as a plate structure. When it is to discharge ice cubes, the ice discharging door 3 may be opened just by opening the end of the ice discharging door 3. Hence, it is ensured that the ice discharging door 3 may be opened with a small force. Additionally, the ice discharging door 3 may be connected to the ice storage box 1 in an articulated manner, so that the ice discharging door 3 may be easily opened just by applying a pushing force onto the end of the ice discharging door 3 and rotating the ice discharging door 3 around the articulating shaft. At the end of taking ice cubes, this pushing force is released, and the ice discharging door 3 will easily return to its original position due to the elasticity of the elastic element.

In this embodiment, still referring to FIG. 4, when the ice discharging door 3 is of a plate structure, in order to prevent the ice discharging door 3 from deforming due to stress, reinforced ribs 301 are provided on a surface of the ice discharging door 3 facing the interior of the ice storage box 1. Each reinforced rib 301 is of a stripe structure, and three reinforced ribs are arranged in parallel. Hence, the overall strength of the ice discharging door 3 is enhanced. Of course, the reinforced ribs 301 may be arranged in other forms, and there may be 1, 2, 3, 4 or more reinforced ribs.

However, during discharging ice cubes, in order to prevent the reinforced ribs 301 from blocking ice cubes, the reinforced ribs 301 may be preferably arranged in a direction perpendicular to the axial direction of the rotating shaft 6. The distance between adjacent reinforced ribs 301 should not be too large, so as to preventing large ice cubes or entire ice cubes from escaping therefrom.

In this embodiment, as shown in FIG. 1 and FIG. 2, since an ice crushing device is arranged inside the ice storage box 1 and this ice crushing device can crush large ice cubes or entire ice cubes and discharge them from the ice storage box for the use of consumers, the types of ice from the ice storage box 1 are increased. That is, not only large ice cubes but also crushed ice may be available.

The fixed ice crushing blade 4 is located at the outlet of the ice storage box 1, and one end of the fixed ice crushing blade 4 is fixedly connected to the ice storage box 1 and the other end thereof is hollowly sleeved on the rotating shaft 6 so that the fixed ice crushing blade 4 is fixed inside the ice storage box 1 at a specified position. The fixed ice crushing blade 4 has a first ice crushing face and a first backside 402 which are arranged away from and oppositely to each other, with the first ice crushing face being away from the outlet of the ice storage box 1 and having first ice crushing teeth 401, and the first backside 402 facing the outlet of the ice crushing box 1.

Additionally, the moving ice crushing blade 5 is sleeved on the rotating shaft 6, and rotates synchronously to the rotating shaft 6. The moving ice crushing blade 5 has a second ice crushing face and a second backside 502 which are arranged away from and oppositely to each other; and the moving ice crushing blade 5 moves toward the direction of the fixed ice crushing blade 4, and during the ice crushing, the second ice crushing face faces the first ice crushing face; and the second ice crushing face has second ice crushing teeth 501, and the second backside 502 is planar. Since the second backside 502 of the moving ice crushing blade 5 is a planar structure, advantages of simple structure and easy machining are provided.

In this embodiment, as shown in FIG. 1 and FIG. 2, the fixed ice crushing blade 4 and the moving ice crushing blade 5 may be arranged in pair, and the ice crushing teeth of the two ice crushing blades which are arranged in pair may be arranged facing one another. The ice crushing teeth are of a wavy or dentate structure, which is advantageous for ice crushing. The fixed ice crushing blade 4 and the moving ice crushing blade 5 may be not arranged in pair, and in this case, the fixed ice crushing blade 4 and the moving ice crushing blade 5 may be alternately arranged, and the ice crushing teeth of the fixed ice crushing blade 4 and the moving ice crushing blade 5 are arranged facing one another.

The following focuses on the operating principle of the ice storage device in this embodiment. As shown in FIG. 1 and FIG. 2, when it is to take large ice cubes (entire ice cubes), the driving device (for example, a motor) drives the rotating shaft 6 to rotate clockwise, and the rotating shaft 6 further drives the stirrer 2 and the moving ice crushing blade 5 to synchronously rotate clockwise. While the second stirring portion 203 stirs ice cubes, a pushing force is applied by ice cubes onto the ice discharging door 3 so that the ice discharging door 3 is opened to take more ice cubes.

Still referring to FIG. 1 and FIG. 2, when it is to take small crushed ice, the driving device (for example, a motor) drives the rotating shaft 6 to rotate counterclockwise, and the rotating shaft 6 further drives the moving ice crushing blade 5 to synchronously rotate counterclockwise. That is, the second ice crushing teeth 501 rotate toward the direction of the first ice crushing teeth 401 to gradually narrow the gap therebetween. As a result, large ice cubes or entire ice cubes in this gap are crushed, and then the crushed ice is discharged from the outlet of the ice storage box 1. During this process, although the rotating shaft 6 drives the stirrer 2 to synchronously rotate counterclockwise, since a gap is maintained between the second stirring portion 203 and the ice discharging door 3, the second stirring portion 203 applies no pushing force onto the ice discharging door 3 by ice cubes, and also the second stirring portion 203 can stir and push some large ice cubes or entire ice cubes to move toward the fixed ice crushing blade 4 to ensure that the ice discharging door 3 is closed and no large ice cubes are discharged therefrom. That is, only the crushed ice is discharged. Hence, different requirements of consumers are satisfied.

In the ice storage device provided by an embodiment of the present disclosure, a stirrer specially designed to facilitate the opening of an ice discharging door is provided inside the ice storage box, a rotating shaft is driven to rotate by a driving device (for example, a motor), the rotating shaft in turn drives the stirring body to rotate, the stirring body further drives the stirring finger to rotate, and the stirring finger pushes large ice cubes or entire ice cubes so that the ice discharging door is forced to open by the pushing of ice cubes. In comparison with the prior art, in such a structural arrangement, by stirring and pushing ice cubes to move toward the ice discharging door by the stirring finger, the ice discharging door is forced to open by the pushing of ice cubes. In comparison with a moving ice crushing blade, there is a large contact area between the stirring finger and ice cubes, that is, there is a large acting area for pushing ice cubes, so that it is very easy to stir more ice cubes and force the ice discharging door to open by the pushing of some ice cubes. That is, the pushing force stressed by ice cubes onto the ice discharging door can be increased, so that the ice discharging door may be opened much more easily and the discharge rate of ice cubes is improved.

Figure 5:
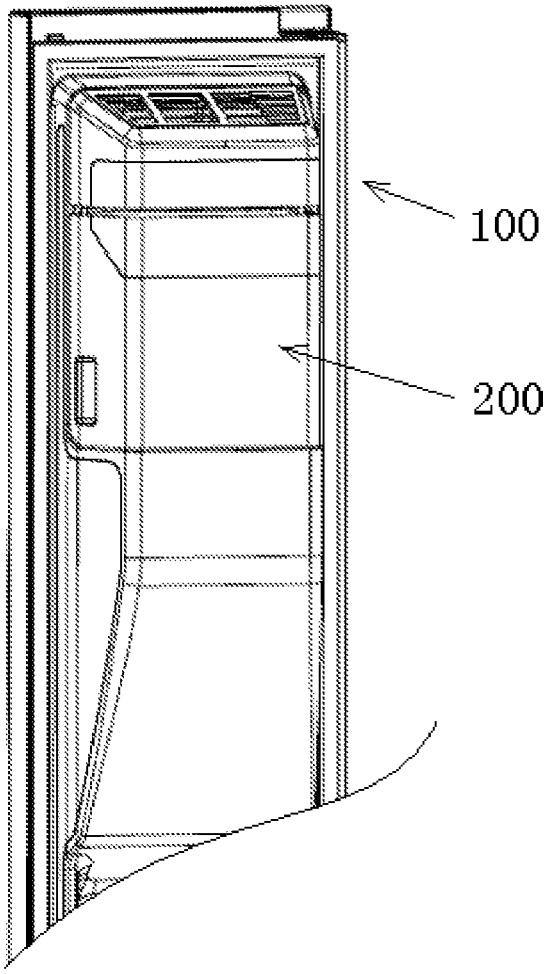

As shown in FIG. 5, another embodiment of the present disclosure provides a refrigerator 100 including an ice maker 200. The ice maker 200 is equipped with the ice storage device as described in any one of the above embodiments. An inlet of this ice storage device is communicated with an outlet of the ice maker 200.

The refrigerator provided by this embodiment of the present disclosure, since equipped with the ice storage device as described in the above embodiments, has all advantages of the ice storage device, and will not be repeated herein. The foregoing descriptions are merely specific implementations of the present disclosure, and the protection scope of the present disclosure is not limited thereto. All changes or replacements, easily obtained by any person familiar with this technical field within the technical scope disclosed in the present disclosure, shall be included in the protection scope of the present disclosure. Hence, the protection scope of the present disclosure shall be subject to that of claims.

We claim:

1. An ice storage device, comprising:

an ice storage box;

an ice crushing device provided inside the ice storage box, wherein the ice crushing device comprises at least one fixed ice crushing blade and at least one moving ice crushing blade;

at least one stirrer provided inside the ice storage box, wherein, the at least one stirrer and the at least one moving ice crushing blade are provided on a rotating shaft and are configured to rotate synchronously to the rotating shaft; and an ice discharging door provided at an outlet of the ice storage box, wherein the ice discharging door is located adjacent to a rotational path of an end of the at least one stirrer;

the at least one stirrer is configured to, when a driving device drives the rotating shaft rotate in a first direction, together with the at least one moving ice crushing blade push ice cubes to apply a pushing force onto the ice discharging door.

2. The ice storage device according to claim 1, wherein the ice discharging door is movable in a direction opposite a movement of the end of the at least one stirrer when the at least one stirrer rotates in a first direction.

3. The ice storage device according to claim 1, wherein, a size L2 of an orthographic projection of the at least one stirrer in an axial direction of the rotating shaft is larger than a size L1 of an orthographic projection of the at least one moving ice crushing blade in the axial direction of the rotating shaft.

4. The ice storage device according to claim 1, wherein, the stirrer comprises a stirring body and at least one stirring finger provided on an outer surface of the stirring body.

5. The ice storage device according to claim 4, wherein, the at least one moving ice crushing blade is in an overall sheet shape so that the at least one moving ice crushing blade is very thin compared with its length and width;

the stirring finger comprises a first stirring portion and a second stirring portion, the second stirring portion is inclined or vertically with respect to the first stirring portion.

6. The ice storage device according to claim 5, wherein a plurality of reinforced ribs are provided on a surface of the ice discharging door facing interior of the ice storage box;

an orthographic projection of the second stirring portion on the ice discharging door is between two reinforced ribs of the plurality of reinforced ribs.

7. The ice storage device according to claim 4, wherein the stirring finger comprises a first stirring portion and a second stirring portion, one end of the first stirring portion is fixedly connected to the outer surface of the stirring body and an opposite end thereof is connected to the second stirring portion, and wherein a distal end of the second stirring portion that is away from the first stirring portion is closer to an inner surface of the ice storage box than is a proximal end of the second stirring portion that is close to the first stirring portion.

8. The ice storage device according to claim 1, the ice discharging door is pivotally hinged to the ice storage box, a pivot shaft is parallel to the rotating shaft, and the ice discharging door extends along an axis of the pivot shaft and is opposite to the at least one stirrer, the at least one stirrer drives the crushed ice to move toward the ice discharging door and presses the ice discharging door to open substantially in a radial direction of the rotating shaft.

9. The ice storage device according to claim 1, wherein, the at least one stirrer is configured to, in response to a rotation of the rotating shaft in a first direction, push ice cubes together with the moving ice crushing blade to apply a pushing force onto the ice discharging door.

10. The ice storage device according to claim 9, wherein, when the rotating shaft rotates in a second direction opposite to the first direction, the at least one fixed ice crushing blade and at least one moving ice crushing blade are configured to crush the ice, the ice discharging door is closed;

when the rotating shaft rotates in the first direction, the ice discharging door opens substantially in the radial direction of the rotating shaft.

11. The ice storage device according to claim 1, further comprising a stirring plate, the stirring plate includes a base and at least one rib protrusion disposed on the base, an outer peripheral surface of the base is substantially conical, and a radius of the base gradually decreases in a direction approaching to the ice crushing device.

12. The ice storage device according to claim 1, wherein, the fixed ice crushing blade is located at the outlet of the ice storage box, with one end of the fixed ice crushing blade being fixedly connected to the ice storage box and an opposite end thereof being hollowly sleeved on the rotating shaft; and the fixed ice crushing blade has a first ice crushing face and a first backside which are arranged away from and oppositely to each other, with the first ice crushing face being away from the outlet of the ice storage box and having first ice crushing teeth, and the first backside facing the outlet of the ice crushing box;

the moving ice crushing blade has a second ice crushing face and a second backside which are arranged away from and oppositely to each other; and the moving ice crushing blade moves toward the fixed ice crushing blade, and during ice crushing, the second ice crushing face faces the first ice crushing face; and the second ice crushing face has second ice crushing teeth, and the second backside is planar.

13. The ice storage device according to claim 1, wherein the rotating shaft is substantially perpendicular to a vertical side wall of the ice storage device.

14. The ice storage device according to claim 1, wherein the at least one stirrer comprises a plurality of stirrer, and at least one stirrer of the plurality of stirrer is provided between the at least one moving ice crushing blade and the at least one fixed ice crushing blade.

15. An ice maker having an ice storage device, wherein an inlet of the ice storage device is communicated to an outlet of the ice maker, wherein the ice storage device comprises:

an ice storage box;

an ice crushing device provided inside the ice storage box, wherein the ice crushing device comprises at least one fixed ice crushing blade and at least one moving ice crushing blade;

at least one stirrer provided inside the ice storage box, wherein, the at least one stirrer and the at least one moving ice crushing blade are provided on a rotating shaft and are configured to rotate synchronously to the rotating shaft; and an ice discharging door provided at an outlet of the ice storage box, wherein the ice discharging door is located adjacent to a rotational path of an end of the at least one stirrer, the at least one stirrer is configured to, when a driving device drives the rotating shaft rotate in a first direction, together with the at least one moving ice crushing blade push ice cubes to apply a pushing force onto the ice discharging door.

16. The ice storage device according to claim 15, wherein the ice discharging door is movable in a direction opposite a movement of the end of the at least one stirrer when the at least one stirrer rotates in a first direction.

17. The ice storage device according to claim 15, wherein, a size L2 of an orthographic projection of the at least one stirrer in an axial direction of the rotating shaft is larger than a size L1 of an orthographic projection of the at least one moving ice crushing blade in the axial direction of the rotating shaft.

18. The ice storage device according to claim 15, wherein, the stirrer comprises a stirring body and at least one stirring finger provided on an outer surface of the stirring body;

wherein, the stirring finger comprises a first stirring portion and a second stirring portion, the second stirring portion is inclined or vertically with respect to the first stirring portion;

wherein, the at least one moving ice crushing blade is in a sheet shape as a whole so that the at least one moving ice crushing blade is very thin compared with its length and width.

19. The ice storage device according to claim 18, wherein a plurality of reinforced ribs are provided on a surface of the ice discharging door facing interior of the ice storage box;

an orthographic projection of the second stirring portion on the ice discharging door is between two reinforced ribs of the plurality of reinforced ribs.

20. A refrigerator comprising an ice maker having an ice storage device, wherein an inlet of the ice storage device is communicated to an outlet of the ice maker, wherein the ice storage device comprises:

an ice storage box;

an ice crushing device provided inside the ice storage box, wherein the ice crushing device comprises at least one fixed ice crushing blade and at least one moving ice crushing blade;

at least one stirrer provided inside the ice storage box, wherein, the at least one stirrer and the at least one moving ice crushing blade are provided on a rotating shaft and are configured to rotate synchronously to the rotating shaft; and an ice discharging door provided at an outlet of the ice storage box, wherein the ice discharging door is located adjacent to a rotational path of an end of the at least one stirrer, wherein, a size of an orthographic projection of the at least one stirrer in an axial direction of the rotating shaft is larger than a size of an orthographic projection of the at least one moving ice crushing blade in the axial direction of the rotating shaft;

the at least one stirrer is configured to, when a driving device drives the rotating shaft rotate in a first direction, together with the at least one moving ice crushing blade push ice cubes to apply a pushing force onto the ice discharging door.

* * * * *